United States Patent [19]

Hurt

[11] 4,321,018

[45] Mar. 23, 1982

[54] PUMP ASSEMBLY DRIVEN BY AN ENDLESS CONVEYER

[76] Inventor: Frank K. Hurt, P.O. Box 818, Bluefield, Va. 24605

[21] Appl. No.: 110,519

[22] Filed: Jan. 8, 1980

Related U.S. Application Data

[63] Continuation-in-part of Ser. No. 898,062, Apr. 20, 1978, Pat. No. 4,213,743.

[51] Int. Cl.[3] ..... F04B 9/02; F04B 17/00; F16H 13/10; B65G 21/00

[52] U.S. Cl. ..... 417/229; 417/362

[58] Field of Search ..... 417/229, 362

[56] References Cited

U.S. PATENT DOCUMENTS

| | | | |
|---|---|---|---|
| 280,247 | 6/1883 | See | 60/494 |
| 433,549 | 8/1890 | Soule | 198/502 |
| 1,973,312 | 9/1934 | Hardinge | 198/37 |
| 2,510,163 | 6/1950 | Wood | 198/79 |
| 2,589,220 | 3/1952 | Buckeridge | 198/82 |
| 2,951,576 | 9/1960 | Buckeridge | 198/37 |
| 3,643,793 | 2/1972 | Diantonio | 198/192 R |
| 4,041,785 | 8/1977 | Roark | 74/11 |
| 4,088,222 | 5/1978 | Hurt | 198/502 |
| 4,133,581 | 1/1979 | Satterwhite | 299/7 |
| 4,213,743 | 7/1980 | Hurt et al. | 417/229 |
| 4,218,881 | 8/1980 | Huffman et al. | 60/325 |

*Primary Examiner*—John J. Vrablik
*Attorney, Agent, or Firm*—Griffin, Branigan & Butler

[57] ABSTRACT

A pump assembly to be used for mining, and the like, is supported on rope-like members (32, 110, 112, 140, 181, 190) of an endless conveyer. In one type of embodiments a channel-shaped mounting member (20, 72, 138, 164, 192) of the pump assembly straddles the rope-like support members and allows the weight distribution of the pump assembly to cause a drive wheel (16, 68, 142, 146, 196) of the pump assembly to come into contact with the endless conveyer (28, 144, 198) to thereby drive a pump (18, 76, 134, 160, 182) of the pump assembly. In a particular one of these types of embodiments the pump (134) is mounted inside the rope-like support member (140) to urge the drive wheel (142) downwardly against the return portion (144) of the endless conveyer and in other particular ones of these types of embodiments the pump (18, 76, 160) is located outside the rope-like support member (32, 181), so that the drive wheel (16, 68, 146) is urged upwardly against the conveying portion (28) of the endless conveyer. In one embellishment a centrifugal pump (76) is used in combination with a speed increasing linkage system (78) to drive the centrifugal pump (76) sufficiently fast to provide adequate pumping. In another embellishment, which can be used with the above mentioned embodiments or in a separate embodiment, the pump assembly is positioned so that its drive wheel (16, 126) only contacts the endless conveyer (28) when the endless conveyer is loaded. This embellishment does not necessarily require pivoting about a single rope-like support member, rather, such a pump assembly can be mounted on rope-like support members (110, 112) on opposite sides of the conveyer. Another type of embodiments employs a pump (182) mounted on the ground being driven by a flexible linkage (186) extending from a seesaw type energy take-off system.

25 Claims, 12 Drawing Figures

FIG. 10
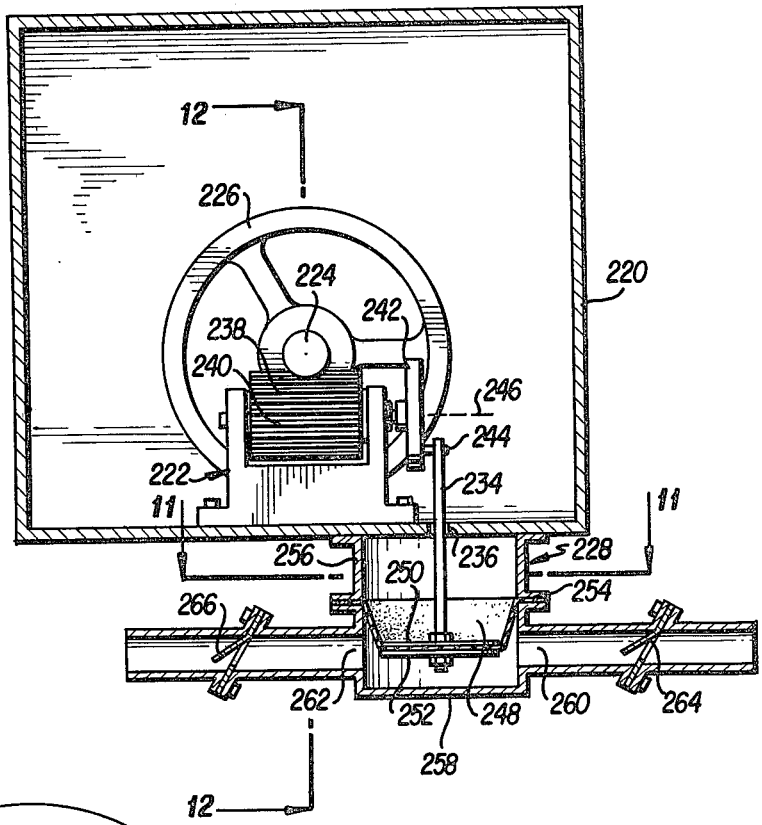
FIG. 11
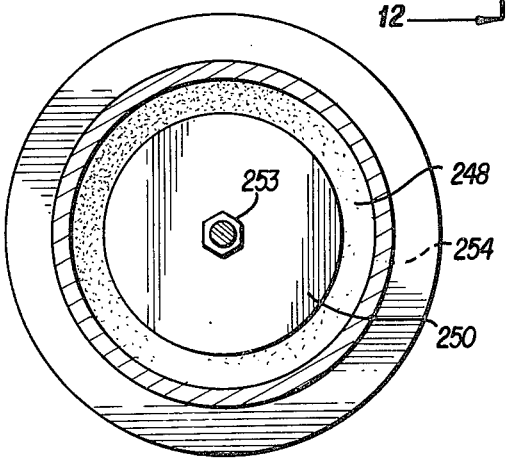
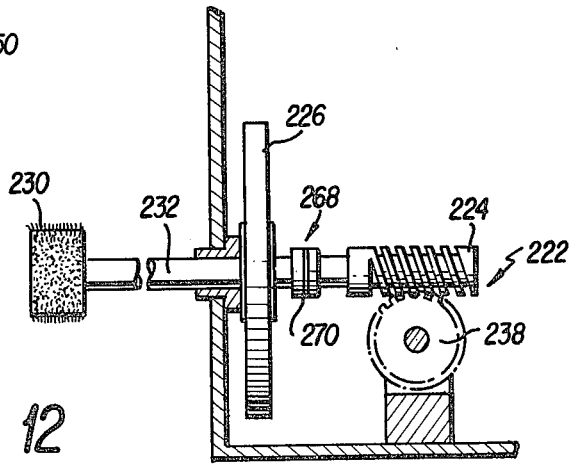
FIG. 12

PUMP ASSEMBLY DRIVEN BY AN ENDLESS CONVEYER

BACKGROUND OF THE INVENTION

This application is a continuation-in-part of application Ser. No. 898,062 filed on Apr. 20, 1978, now U.S. Pat. No. 4,213,743, by Frank K. Hurt for a Pump Assembly and the information in that application is hereby incorporated herein by reference.

This invention relates broadly to the art of liquid pumps to be used in mines or the like.

Coal mines, and other types of mines, often have the problem of water accumulation therein and it is, therefore, necessary to exhaust such water from the mines. It is rather common practice to place electrical or gasoline powered pumps in the vicinity of liquid puddles in mines to pump the liquids from mines through hoses extending outside the mines. A difficulty with such pump systems is that the electrical energy must be extended thereto or they must be periodically fueled. In addition to the extra effort and expense associated with providing energy to these systems, they are somewhat unsafe in that both gasoline and electric motors can cause combustion of coal dust, etc. Fire suppression equipment and/or explosion-proof electric motors are sometimes required to reduce this hazard, however, such equipment is unduly expensive. Thus, it is an object of this invention to provide a pump assembly for use in mines, and the like, which utilizes safe energy already available at most locations within mines so that the pump assembly does not require the stringing of additional electrical wires thereto, the periodic refueling thereof, or the utilization of expensive equipment, but which, is safer than most prior-art systems.

Still another difficulty with the prior art systems described above is that their long hoses are costly and are sometimes cumbersome in the mines. Thus, it is another object of this invention to provide a pump system which does not necessarily require the use of long hoses extending through mines but yet evacuates liquids from the mines.

Yet another difficulty with many prior-art pumping systems is that electrical, gasoline, or other types of independent motive systems used therefor are expensive to buy and unduly subject to malfunctions during operation thereof. Therefore, it is another object of this invention to provide a pump system which does not require an independent motive source to drive it.

A problem with many water pumps used in mines is that they get easily clogged with dust, and other debris and are damaged if they run dry. It is an object of this invention to provide a pump which meets the other objects, and also does not easily clog and is not damaged by running dry.

It is a further object of this invention to provide a pumping system for use in mines and the like which is uncomplicated in structure, easy to mount, and relatively inexpensive.

SUMMARY

According to an aspect of this invention, a pumping assembly for use in mines includes a channel-shaped mounting member for mounting the system on conveyor-supporting wire ropes. The channel-shaped mounting member allows the pumping assembly to be pivoted by weight distribution such that a drive wheel of the pumping system is urged against the conveyor belt to drive a pump of the pumping assembly. In one embodiment the pump of the pumping assembly is positioned inside the channel-shaped mounting member so as to drive the wheel against a return portion of the conveyor belt and in another embodiment the pump is located outside the channel-shaped mounting member to urge the drive wheel against the conveying portion of the conveyor belt. In one embodiment an impeller of a roller pump is driven directly by the drive wheel but in another embodiment a centrifugal pump is used and its impeller is driven by a speed-increasing linkage attached to the drive wheel. In another embodiment, the pumping system is positioned such that its drive wheel only comes into contact with the conveyor belt if the conveyor belt is loaded. Thus, the pump only pumps when the conveyor belt is loaded. With this system the pump exhausts liquids onto a loaded conveyor belt but not onto an empty one. In this system it is not necessary for the pump system to pivot about the rope-like support member but rather it can be mounted on rope-like support members positioned on opposite sides of the conveyor.

In a preferred embodiment the pump is a diaphragm pump with flap valves, the diaphragm being flexible, but not substantially resilient. The valves are positioned so that gravity aids in their closing. The diaphragm pump is designed to pump from 400–600 gallons of water per hour and to have a stroke of from $2\frac{3}{4}$ to $3\frac{1}{2}$ inches in length. The drive wheel is constructed with bristles on the outer diameter, and has a diameter of from 4 to 7 inches. A speed reducer having a reduction ratio of from 6 to 11 is linked between the drive-wheel shaft and the diaphragm.

Other embodiments of the pump employ centrifugal and roller and vane type pumps.

BRIEF DESCRIPTION OF THE DRAWINGS

The foregoing and other objects, features and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

FIG. 10 is a partially sectional end view of the particular diaphragm pump arrangement of FIG. 9;

FIG. 11 is a sectional view taken on line 11—11 in FIG. 10; and

FIG. 12 is a sectional view taken on line 12—12 in FIG. 10.

DESCRIPTION OF PREFERRED EMBODIMENT

Figure 1:
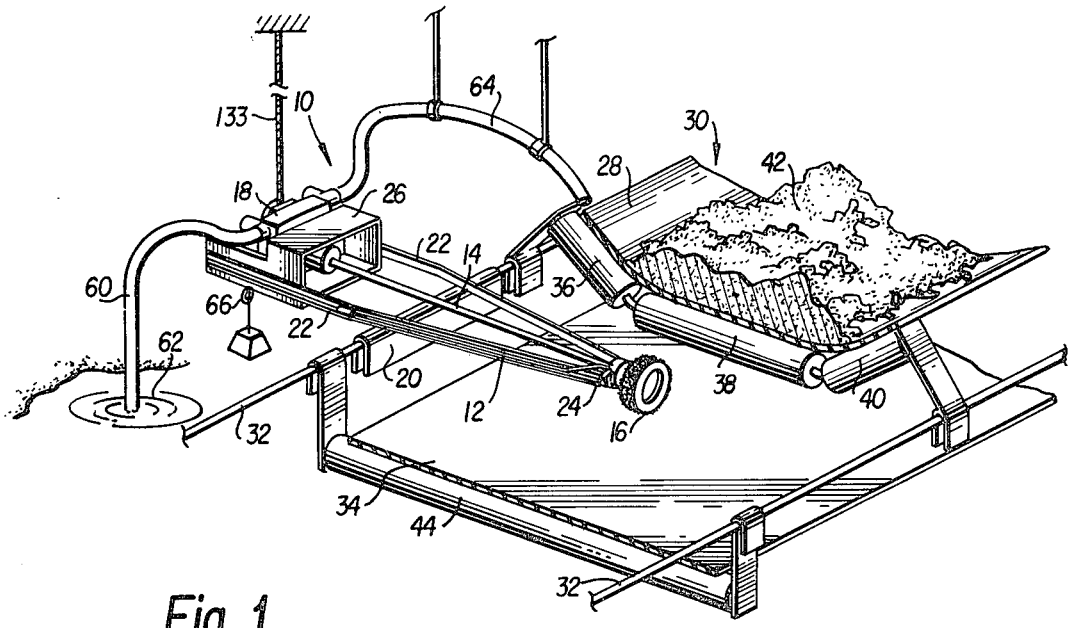
FIG. 1 is an isometric cutaway view of a conveyor belt system in which a pump assembly employing principles of this invention is used.

A pumping assembly 10 basically comprises an elongated frame 12, a drive shaft 14, a drive wheel 16, a pump 18, and a channel-shaped mounting member 20.

The elongated frame 12 is generally an A-frame formed by struts 22 merging at a bearing mount 24 at one end and being attached to a U-shaped pump-holding tray 26 at the opposite end. In the illustrated embodiment the struts 22 have L-shaped cross-sections and are made of steel, however, other arrangements could probably be used equally as well.

The drive shaft 14 rides in a bearing (not shown) held by the bearing mount 24. The drive wheel 16 is attached to, and rotatable with, the outer end of the drive shaft 14. In the illustrated embodiment, the drive wheel is constructed of nylon bristles (brush like) so as to provide good friction between the drive wheel and the underside of a conveying portion 28 of a conveyor belt 30. However, it is also possible to make the drive wheel in other ways such as with steel bristles or solid rubber. It is thought that bristles obtain the best traction on wet, oily, slimy, or otherwise muddy belts.

With regard to the conveyor belt, the illustrated conveyor belt 30 is of a type used in many coal, and other types, of mining operations. The conveyor belt 30 is mounted on wire ropes, or cables 32 such as are depicted in the drawings. In such cases there is a conveying portion 28 of the belt and a return portion 34. The conveying portion 28 is carried on trough guide rollers 36, 38 and 40 which are arranged to shape the conveying portion 28 of the belt into a trough for holding coal 42 or other conveyed material. The return portion 34 of the belt 30 rides on straight guide rollers 44.

Both the trough guide rollers 36, 38 and 40 and the straight guide rollers 44 are supported by the wire rope 32.

Figure 2:
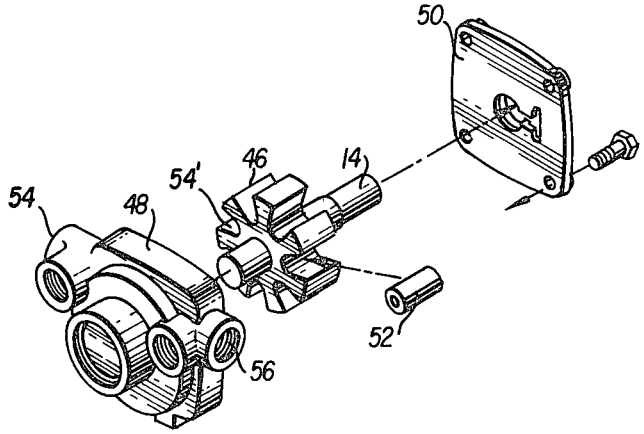
FIG. 2 is a simplified exploded view of the pump of the pump assembly of FIG. 1.

The pump 18 is mounted on the pump-holding tray 26 (although it would also be possible to attach the struts 22 directly to the pump 18 and eliminate the pump-holding tray 26) and this pump is shown in more detail in FIG. 2. Basically, the drive shaft 14 is attached to an impeller 46 of the pump to drive the impeller 46 at the same speed at which the drive wheel 16 rotates. In this respect, the bristle-type drive wheel 16 is between 4 and 6 inches in diameter (the diameter varies in order to obtain the proper combination of speed and torque necessary for most efficient and desirable pump operation) but is preferably around 5 inches in diameter. A conveyor belt normally travels at around 500 feet per minute. Thus, the impeller 46 is driven around 400 RPM's. Such a rotational speed is adequate for the roller or vane, type of pump depicted in FIGS. 1 and 2. In this respect, this roller pump mainly comprises a pump body 48, an end plate 50, the impeller 46 and rollers 52 (only one shown). In operation, when the shaft 14 rotates the rollers 52, which ride in slots 54 in the impeller 46, move in and out of the slots to follow an eccentric shape of a cavity in the pump body 48. This in-and-out motion creates a negative pressure at the inlet 56 and a positive pressure at the outlet 54. Such a pump is designed to operate at the speed of the shaft 14 (400–500 rpm with the drive wheel 16 having a diameter of between four and six inches). Such a pump is sold under the trademark TEEL, model 1P736 by Dayton Electric Manufacturing Co., Chicago, Ill. 60648.

In the FIG. 1 embodiment the inlet 56 of the pump is attached to a hose 60 which is extended into a puddle of water 62. The outlet 54 of the pump 18 communicates with a hose 64 which extends above the conveying portion 28 of the conveyor 30. Thus, liquids that are pumped by the pump 18 from the puddle 62 are deposited onto the conveying portion 28 of the conveyor 30 and conveyed out of a mine. However, it should be understood that the pumping assembly 10 can be used equally well conveying liquids through pipes or hoses to other sections of a mine to be removed by other means, such as a larger motor or engine-driven pump.

The channel-shaped mounting member 20 is welded to the bottom side of the struts 22 intermediate the pump 18 and the drive wheel 16 at a location to serve as a fulcrum. In this respect, the channel-shaped mounting member 20 basically forms a U-shaped channel which opens downwardly and which is designed to fit onto the conveyor-supporting wire ropes 32 as is depicted in FIG. 1. When the pump assembly is thusly mounted on a wire rope 32, the elongated frame 12, with the drive wheel 16, and the pump 18, are free to pivot about the wire rope 32, according to weight distribution to engage the drive wheel 16 with the conveying portion 28.

An embellishment of this device includes eyebolts 66 to which weights can be tied for providing additional pivoting action to increase the bias of the roller 16 against the conveying portion 28 of the conveyor belt.

In operation, when it is desired to use the pump assembly 10 of this invention to pump water, it is mounted by inserting the drive-wheel end 16 of the elongated frame 12 between the conveying portion 28 of the conveyor belt 30 and the conveyor-supporting wire rope 32. The elongated frame 12 is manipulated to place the channel-shaped mounting member 20 over the wire rope 32 and the pump assembly is then released to pivot on the wire rope 32. The weight at the pump end 18 of the elongated frame 12 overcomes the weight at the other end to move the drive wheel 16 upwardly against the bottom, or clean side, of the conveying portion 28 of the conveyor belt 30. In this respect, it should be noted that the drive wheel 16 strikes the bottom of the conveying portion 28 at a lower floor, or apex of the returned portion. The floor is relatively broad and it is not necessary that the drive wheel 16 strike the exact apex point. This feature allows the pump assembly of this invention to be used with belts of various widths. For example, most underground coal mine belts are either 36 or 42 inches wide; however, some are 30-inches and some are 48-inches wide. By fabricating the drive wheel 16 approximately 21 inches from the channel-shaped mounting member 20 the pump assembly can be made to fit all of these belt sizes.

Once the pump assembly of this invention is seesaw mounted on the wire rope 32, the impeller 46 of the pump 18 is linked with the conveyor belt. Thus, as the conveyor belt moves it rotates the drive wheel 16, which rotates the drive shaft 14, and the impeller 46. The impeller 46, with the rollers 52, pump water from the puddle 62 onto the conveying portion 28 of the conveyor 30, or through pipes or hoses to another area.

A limitation of the pumping assembly of FIGS. 1 and 2 is that the roller pump 18 sometimes clogs from dirt, grime, etc. passing through it.

Figure 3:
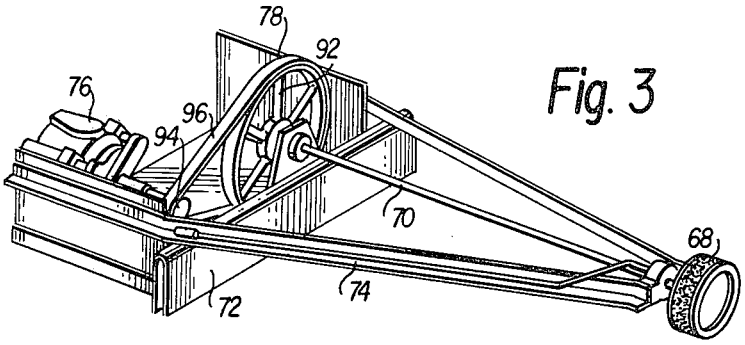
FIG. 3 is an isometric view of a second embodiment pump assembly.

FIG. 3 depicts a more clog resistant embodiment of this invention having similarities with the embodiment already described in that it includes a drive wheel 68, a drive shaft 70, a channel-shaped mounting member 72, an elongated frame 74, and a pump 76. However, this pump assembly differs from the pump assembly of FIGS. 1 and 2 in that it employs a centrifugal type pump 76 and a linkage 78 thereto to increase the rotational speed of the pump 76. In this respect, with reference to FIG. 4, a centrifugal pump, to be effective, must rotate at a significantly higher speed than the drive wheel 68. Liquid enters an inlet 80 in a housing 82 and impinges on an impeller 84 at its center 86. The impeller 84 has spiraled vanes 88 which drive the liquid outwardly toward an outlet 90 when the impeller 84 is rotated. Thus, a negative pressure is created at the inlet 80 and a positive pressure at the outlet 90.

The linkage 78 between the drive shaft 70 and the impeller 84 of the pump 76 includes a large pulley 92 attached to the drive shaft 70, a small pulley 94 attached to an impeller shaft 70A, and a belt 96 extending therebetween. The relatively small ($1\frac{1}{4}$ inch) centrifugal pump 76 uses this type of drive to increase its speed to approximately 2,400 RPM which is about 5 times greater than the drive wheel speed of 400 to 500 RPMs of the FIG. 1 embodiment. Such a centrifugal pump is sold by Dayton Electric Manufacturing Co., Chicago, Ill. 60648, under the trademark TEEL, model 1P884.

This centrifugal pump can handle solids up to $\frac{3}{8}$ inch diameters which is highly desirable for pumping in a mine-type environment.

Figure 4:
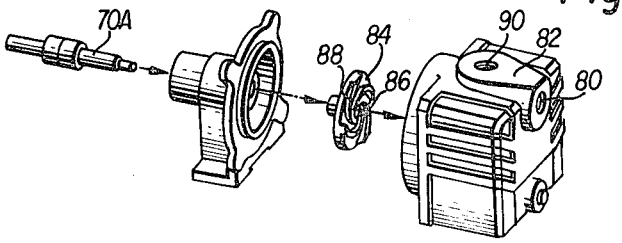
FIG. 4 is an exploded view of the pump of the FIG. 3 pump system.

Operation of the FIGS. 3 and 4 embodiment is similar to operation of the FIGS. 1 and 2 embodiment in that the assembly is mounted on a wire rope 32 in a seesaw manner so that the drive wheel 68 is urged upwardly against a conveying portion 28 of an endless conveyor. Movement of the conveying portion 28 of the conveyor drives the drive wheel 68 which, in turn, drives the pump impeller 84 via the drive shaft 70, the large pulley 92, the belt 96, and the small pulley 94 at a sufficiently fast speed to pump liquids from puddles onto the conveying portion 28 of an endless conveyor, through long hoses out of mines or to some other means of disposal, such as a larger pump.

Figure 5:
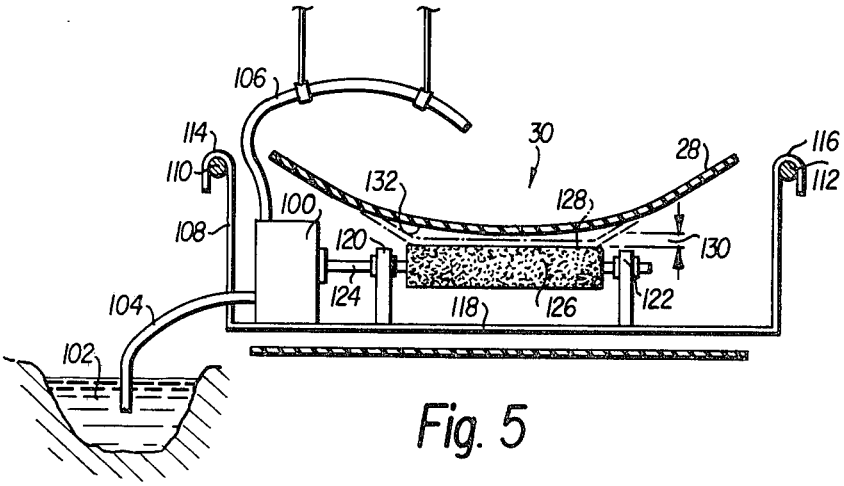
FIG. 5 is a sectional view of a belt system in which a pump assembly mounted in accordance with yet another embodiment is employed.

FIG. 5 depicts another embodiment of this invention wherein a pump 100 pumps liquid from a puddle 102 onto a conveying portion 28 of a conveyor 30 via an inlet hose 104 and an exhaust hose 106. However, the pump 100 is mounted quite a bit differently than in the previously described embodiments. In this respect, the pump 100 is mounted on a frame 108 which is supported on oppositely positioned conveyor-supporting wire ropes 110 and 112 by means of hooks 114 and 116 respectively. Thus, the pump assembly of FIG. 5 does not pivot in seesaw fashion as in the previously described embodiments. A horizontal portion 118 of the frame 108 supports bearings 120 and 122 and the pump 100. A drive shaft 124 rotatively rides in the bearings 120 and 122 and is linked to an impeller (not shown) of the pump 100. In this respect, the pump 100 can be of various types, and a pump which would function properly in this embodiment is the pump of FIG. 4, with a speed increasing linkage. An enlarged bristle drum 126 (it could also be a rubber covered drum) of FIG. 5 is fixedly mounted on the drive shaft 124 to rotate therewith. It should be noted that an upper outer surface 128 of the enlarged bristle drum 126 is spaced a distance 130 from the lower surface 132 of an empty conveying portion 28; however it is in contact with the lower surface 132 of the conveying portion 28 when the conveying portion 28 is loaded. In this manner, the pump 100 is only driven when the conveying portion 28 is loaded. Thus, liquid is not pumped onto an empty conveyor belt in which it can flow downstream to accumulate at a low point on the belt, but rather is pumped only onto coal, or the like, which absorbs the liquid and therefore carries it out of the mine.

The protective spacing arrangement of FIG. 5 is also accomplished with the arrangements of FIGS. 1 and 3 by anchoring the pumps from above by a tether 133 (FIG. 1) to not permit counterclockwise rotation of the pump assemblies beyond a certain rotated position.

Figure 6:
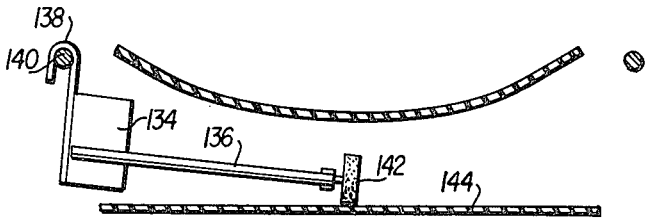
FIG. 6 is a sectional view of a conveyor-belt system having mounted thereon a pump assembly in accordance with yet another embodiment.

FIG. 6 depicts yet another arrangement of this invention wherein a pump 134 is arranged on an elongated frame 136 inside a channel-shaped mounting member 138. Thus, when the pump assembly of FIG. 6 is mounted on a wire rope 140, it pivots thereabout such that its drive wheel 142 is urged downwardly against a return portion 144 of an endless conveyor. That is, the pump assembly of FIG. 6 is rotated about the wire rope 140 in a clockwise direction as was not the case in the FIGS. 1 and 3 embodiments. In this embodiment, the pump 134 can be of various types and it is not thought necessary to go into further detail. In addition, this pivoting arrangement is used with other types of energy utilization devices such as belt switches and the like.

Figure 7:
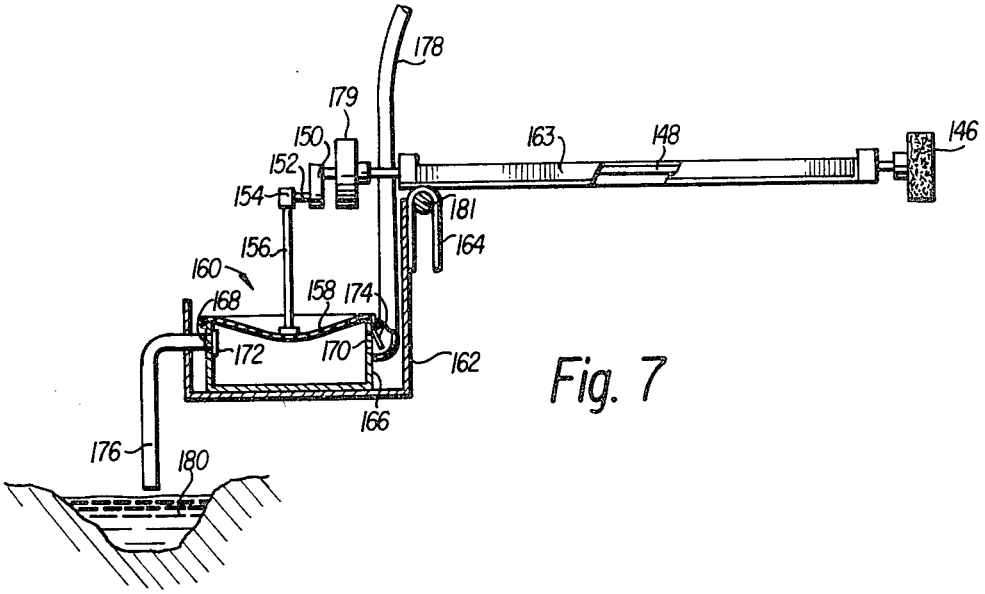
FIG. 7 is a sectional schematic view of a pump assembly similar to the assemblies of FIGS. 1 and 3, but with a diaphragm-type pump.
Figure 8:
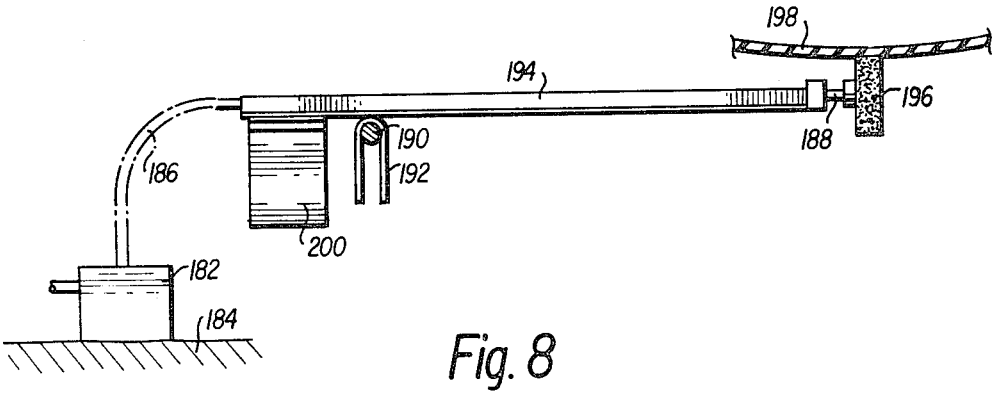
FIG. 8 is a sectional schematic view of a modified embodiment pump assembly in accordance with this invention.

FIG. 7 depicts an alternate embodiment of this invention which is similar to the embodiments of FIGS. 1 and 3 but which employs a diaphragm pump rather than the roller pump of FIG. 1 or the centrifugal pump of FIG. 3. In this respect, a drive wheel 146 is attached to a shaft 148 which is in turn attached to a crank 150. A pin 152 of the crank 150 rides in a bearing 154 whose outside race is attached to a shaft 156. The other end of the shaft 156 is attached to a diaphragm 158 which is part of a pump 160. The pump 160 is mounted on a pump tray 162 which is, in turn, mounted to appropriate struts 163 and a channel-shaped mounting member 164 in the same manner as are the corresponding elements of the pump assemblies of FIGS. 1 and 3. In any event, the pump 160 includes a pump housing 166 defining inlet and outlet openings 168 and 170. The inlet and outlet openings have appropriate one-way valves 172 and 174 mounted thereat for controlling the flow of fluid into and out of the pump housing 166. In the depicted embodiment, these valves are represented as being flap valves, however, in many diaphragm pumps they are ball valves etc. Inlet and outlet hoses 176 and 178 are attached to the pump housing 166 at the inlet and outlet openings 168 and 170. A flywheel 179 is mounted on the shaft 148 to provide extra inertia to overcome pump load peaks at the beginnings of the intake and discharge strokes.

In operation, the pump assembly of FIG. 7 is mounted on a rope-like conveyer support 181 in the manner of the other pump assemblies described above. When the drive wheel 146 is rotated by an endless conveyor belt it rotates the shaft 148, the crank 150, and the crank pin 152. The crank pin 152 carries the bearing 154 and its attached shaft 156 up and down in an oscillating manner. The shaft 156, therefore, moves the attached diaphragm 158 up and down, in a reciprocating manner. The up and down motion of the diaphragm 158 increases and decreases the volume of the interior of the pump housing 166 therefore creating negative and positive pressure therein. These negative and positive pressures automatically actuate the one-way valves 172 and 174 to cause pumping from a liquid pool 180 through the inlet tube 176, the pump housing 166, and finally the outlet tube 178 onto the loaded conveyor belt, through hoses or tubes out of the mine, or simply to other areas for further conveying by larger pumps.

A diaphragm pump 160 which could be used in this device is sold by Barnes Manufacturing Company of Oakland, Calif. as part of an electric motor driven lightweight cast iron diaphragm pump assembly models 20 CDE and 20 CDE-1, however, other diaphragm pumps would also work in this environment.

The diaphragm pump of FIG. 7 has benefits over the roller and centrifugal pumps of FIGS. 1 and 3 in that it can run dry for longer periods of time without damage. In this respect, often water puddles in mines are relatively small and the small amounts of water are pumped dry fairly quickly. This means that pumps, which are often left unattended, must run dry until enough water trickles back into the puddle to allow the pump to reprime itself. Therefore, the ability of a diaphragm pumping assembly to run dry without damage and then to reprime itself is desirable. Another advantage of diaphragm pumps is that they can be operated at relatively low speeds. In addition, diaphragm pumps handle solids relatively well.

The above described embodiments of this invention were all in the parent application Ser. No. 898,062, filed on Apr. 20, 1978, now U.S. Pat. No. 4,213,743. The following embodiment, depicted in FIGS. 9–11 is a newly added embodiment of the invention, and is thought by the inventor, to be the preferred embodiment.

Figure 9:
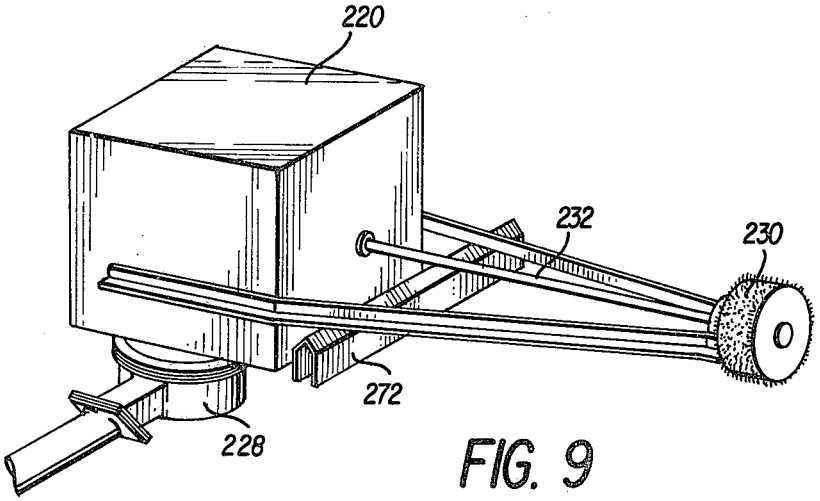
FIG. 9 is an isometric view of a particular diaphragm pump arrangement of this invention.

Basically, the embodiment of FIGS. 9–11 is a special diaphragm-pump arrangement having the benefits of the diaphragm-pump structure of FIG. 7. In this arrangement, a main assembly housing 220 encloses a speed reducer 222, including a worm gear 224, and a flywheel 226. A diaphragm pump 228 is coupled to a drive wheel 230 via a drive shaft 232, the worm gear 224, a speed reducer gear 238, a linkage wheel 242, and a rigid link 234. As can be seen in FIG. 10, the diaphragm pump 228 is attached to the underside of the main assembly housing 220 and the rigid link 234 extends through an opening 236 in the main assembly housing 220. The speed reducer gear 238 has teeth 240 which mesh with threads of the worm gear 224 and the linkage wheel 242, is driven by the speed-reducer gear 238. The rigid link 234 is rotatably, eccentrically mounted on the linkage wheel 242. The distance of a swivel mount 244 from an axis 246 of the linkage wheel 242 determines the length of stroke for a diaphragm 248.

With regard to the diaphragm 248, this element is made of neoprene rubber reinforced with nylon. The diaphragm is flexible, however, it is not substantially resilient and, therefore, does not substantially stretch. That is, the pumping action derived from the diaphragm 248 is obtained by diaphragm flexing, rather than stretching. Attached to the central portion of the diaphragm 248, on the top and bottom thereof, are two rather large washers 250 and 252. These washers 250 and 252 are constructed of a rigid metal and they rigidify the central portion of the diaphragm 248. The rigid link 234 has a threaded end, with two nuts mounted thereon, one above the washer 250 and the other below the washer 252 to thereby link the rigid link 234 to the washers, and to hold the washers on the diaphragm 248.

The diaphragm 248 is mounted about its periphery 254 between an upper portion 256 of a diaphragm-pump housing and a lower portion 258 of the pump housing. The upper and lower portions are bolted together with the diaphragm periphery 254 clamped therebetween.

The upper portion of the pump housing serves as a mount for mounting the diaphragm pump 228 to the main assembly housing 220. The lower portion 258 of the pump housing serves as a transitory container for water being pumped with the pump 228. Liquid enters through an inlet opening 260 and exits through an exit opening 262 as the diaphragm 248 is respectively moved upward and downward by the rigid link 234. One-way check valves 264 and 266 are respectively mounted in the inlet and outlet openings 260 and 262. The one-way check valves 264 and 266, as can be seen in FIG. 10, are oriented on an angle so that gravity acts to help close them under the appropriate circumstances. In this respect, as the diaphragm 248 is moved upwardly, the outlet valve 266 is closed and the inlet valve 264 is opened by fluid pressure. The opposite is true when the diaphragm 248 is moved downwardly.

The drive wheel 230 has nylon bristles about the periphery thereof, has a diameter of approximately six inches, and has a width of around three inches. The outer end of the drive wheel 230 is approximately 27 inches from the main assembly housing 220, and the main assembly housing 220 is approximately 15 inches in length. Thus, the whole assembly is approximately 42 inches long.

The flywheel 226, which is rigidly mounted to the drive shaft 232, weighs 16 pounds, with most of this weight being distributed near the outside periphery, and has a diameter of 12 inches. Ideally, it is thought, the speed reducer 222 is designed with appropriate worm threads and gear tooth sizes to provide a drive shaft pump stroke ratio in the range of from 6 to 11, depending on the size of the membrane 248 and the length of the membrane stroke. It has been found that the diaphragm pump of this invention functions best if it pumps in the range of from 400 to 600 gallons per hour, preferably around 500 gallons per hour. In a preferred embodiment, the membrane 248 has a diameter, where it is attached, of $6\frac{3}{4}$ inches, and the washers 250 have diameters of $5\frac{1}{2}$ inches. The membrane stroke is approximately $2\frac{7}{8}$ inches.

FIG. 12 depicts a flexible coupling 268 between the drive shaft 232 and the worm gear 226. The flexible coupling 268 comprises a resilient substance 270 fixedly attached to the drive shaft 232 and the worm gear 226. This resilient substance 270 smoothes out vibration from the drive wheel 230 and thereby protects the speed reducer 222.

In operation, this particular diaphragm-pump assembly is mounted onto a wire rope by its wire-rope mount 272—although it should be understood that this pump could also be used with a wire-rope mount arrangement wherein there are two U-shaped channels positioned at opposite ends of a frame as is depicted in FIG. 5—and the weight of the unit brings the drive wheel 230 into contact with the bottom of a conveying-belt portion of a conveyor belt. The drive wheel 220 is rotated by the conveyor belt, and this rotation is transmitted through the speed reducer 222 in a ratio of 11:1 to the rigid link 234. Since a conveyor belt normally travels at around 500 feet per minute, and in view of the diameter of the drive wheel 230, and the speed reducer 222 the diaphragm pump 228 is driven at a speed of approximately 35 strokes per minute, to pump water at approximately 500 gallons per hour (eight gallons per minute or one quart per stroke).

It will be appreciated that this particular diaphragm-pump arrangement is highly beneficial in that it requires less maintenance than most other pumps by being less susceptible to clogging and able to run dry. Further, this pump can be driven by power taken from a belt to operate in a range in which it can effectively operate. Further, the arrangement of this pump assembly with a main assembly housing enclosing a speed reducer and having a pump depending therebelow, is unusually compact and convenient.

While this invention has been particularly shown and described with reference to preferred embodiments, it will be understood by those skilled in the art, that various changes in form and detail may be made therein without departing from the spirit and scope of the invention. That is, while present preferred embodiments of the invention have been illustrated and described herein, it may be otherwise embodied and practiced within the scope with the following claims.

I claim:

1. A liquid pump assembly to be mounted on a rope-like member of an endless conveyer support, for engaging an endless conveyor to be thereby powered, said rope-like member being positioned adjacent to and extending parallel with, the endless conveyer, the endless conveyer having conveying and return portions, said liquid pump assembly comprising:

an elongated frame;

a shaft journaled for rotation in said frame and extending longitudinally along said frame;

a drive wheel attached to and rotatable with said shaft;

a liquid pump mounted on said frame at a position spaced from said drive wheel, said pump defining a liquid inlet and outlet, said pump having an impeller means movably linked to said shaft for moving in response to rotation of said shaft for creating a pressure differential between said inlet and outlet; and a mounting means attached to said elongated frame for mounting said elongated frame on said rope-like member running parallel to said endless conveyor for allowing movement of said drive wheel toward contact with said endless conveyer to be thereby driven by said endless conveyer.

2. A liquid pump assembly as in claim 1 wherein is further included a linkage means mounted on said elongated frame and attached between said shaft and said impeller for rotating said impeller in response to rotation of said shaft and for changing the rotational speed at which said impeller is driven to be different than the rotational speed of said shaft.

3. A liquid pump assembly as in claim 1 wherein said mounting means allows said pump assembly to pivot freely about said rope-member with the weight of said frame and its attachments causing said pivoting of said frame to bring said drive wheel into contact with said endless conveyer.

4. A liquid pump assembly as in claim 3 wherein said mounting means defines an open-sided channel-shaped member positioned crosswise of said elongated frame for straddling said rope-like member running parallel with said endless conveyer.

5. A liquid pump assembly as in claim 3 wherein is further included an extra weight mounted on said elongated frame for increasing the pressure with which said drive wheel is urged against said endless conveyer.

6. A liquid pump assembly as in claim 3 wherein said drive wheel is constructed of radially extending bristles.

7. A liquid pump assembly as in claim 3 wherein said mounting means is positioned intermediate said pump and said drive wheel.

8. A liquid pump assembly as in claim 1 wherein said mounting means comprises a substantially U-shaped channel member means positioned crosswise of said elongated frame for portably straddling said rope-like member extending parallel to said endless conveyer.

9. A liquid pump assembly as in claim 1 wherein said pump assembly includes a means for positioning its drive wheel to be spaced from the endless conveyer when the endless conveyer is not loaded, but to be in contact with the endless conveyer when the endless conveyer is loaded.

10. A liquid pump assembly as in claim 1 wherein said liquid pump is a diaphragm pump.

11. A liquid pump assembly as in claim 10 wherein said diaphragm pump employs one-way flap valves at inlet and exit openings thereof.

12. A liquid pump assembly as in claim 11 wherein said flap valves are at angular attitudes in closed positions such that gravity tends to apply force on the valves to urge them toward their seats.

13. A liquid pump assembly as in claim 10 wherein is further included a flywheel mounted on the shaft.

14. A liquid pump assembly as in claim 10 wherein said pump is designed to pump between 400 and 600 gallons of liquid per hour for a conveyer speed of approximately 500 feet per minute.

15. A liquid pump assembly as in claim 14 wherein said pump is designed to pump approximately 500 gallons per hour for a conveyer speed of 500 feet per minute.

16. A liquid pump assembly as in claim 10 wherein said drive wheel has a diameter which is greater than four inches, but smaller than seven inches.

17. A liquid pump assembly as in claim 10 wherein the diaphragm comprises a flexible membrane, but is not substantially resilient.

18. A liquid pump assembly as in claim 17 wherein said membrane has rigid washers attached to a central portion thereof.

19. A liquid pump assembly as in claim 10 wherein is further included a speed reducer positioned between said drive shaft and the diaphragm of said diaphragm pump.

20. A liquid pump assembly as in claim 19 wherein said speed reducer provides a drive-shaft rotation/-pump stroke ratio of between 6 and 11.

21. A liquid pump assembly as in claim 10 wherein a flexible coupling couples said drive shaft with said pump.

22. A liquid pump assembly as in claim 10 wherein said frame comprises a main assembly housing for enclosing a speed reducer, said speed reducer being linked to said shaft, said diaphragm pump being mounted to a floor of said main assembly housing, below said speed reducer, and being linked to said speed reducer.

23. A liquid pump assembly as in claim 22 wherein said speed reducer comprises a worm gear attached to said shaft and a toothed gear meshed with said worm gear to be thereby rotated to drive said diaphragm pump.

24. A liquid pump assembly as in claim 1 wherein said frame comprises a main assembly housing for enclosing a speed reducer, said speed reducer being linked to said shaft, said pump being mounted to a floor of said main assembly housing, below said speed reducer, and being linked to said speed reducer.

25. A liquid pump assembly as in claim 24 wherein said speed reducer comprises a worm gear attached to said shaft and a toothed gear with said worm gear to be thereby rotated to drive said pump.

* * * * *